US008104120B2

(12) United States Patent
Hornbach et al.

(10) Patent No.: US 8,104,120 B2
(45) Date of Patent: Jan. 31, 2012

(54) HEIGHT ADJUSTABLE BED WITH A PUSH CHAIN ASSEMBLY

(75) Inventors: David W Hornbach, Brookville, IN (US); John K Heidlage, Hamilton, OH (US)

(73) Assignee: Hill-Rom Services, Inc.

( * ) Notice: Subject to any disclaimer, the term of this patent is extended or adjusted under 35 U.S.C. 154(b) by 15 days.

(21) Appl. No.: 12/708,178

(22) Filed: Feb. 18, 2010

(65) Prior Publication Data

US 2011/0197361 A1 Aug. 18, 2011

(51) Int. Cl.
*A47B 7/02* (2006.01)

(52) U.S. Cl. ..... 5/611; 5/618; 5/617

(58) Field of Classification Search ..... 5/618, 611, 5/200.1, 616, 617, 93.1, 93.2, 100, 83.1, 5/607, 610; 187/200, 211; 254/1
See application file for complete search history.

(56) References Cited

U.S. PATENT DOCUMENTS

| | | | | |
|---|---|---|---|---|
| 980,181 | A | 1/1911 | Asbury | |
| 2,818,189 | A | 12/1957 | Schreck | |
| 3,021,024 | A | 2/1962 | Nagin | |
| 3,082,893 | A | 3/1963 | Hollings | |
| 3,153,940 | A | 10/1964 | Patrignani | |
| 3,672,237 | A | 6/1972 | Nagin | |
| 3,845,591 | A * | 11/1974 | Stine | 52/67 |
| 4,014,136 | A | 3/1977 | Hemens et al. | |
| 4,037,744 | A | 7/1977 | Nagin, Jr. et al. | |
| 4,271,830 | A * | 6/1981 | Moon | 5/613 |
| 4,299,585 | A | 11/1981 | Nagin, Jr. et al. | |
| 4,406,096 | A | 9/1983 | Matsutani | |
| 4,644,595 | A | 2/1987 | Daniel | |
| 4,830,337 | A | 5/1989 | Ichiro et al. | |
| 5,123,916 | A * | 6/1992 | Riddle et al. | 606/243 |
| 5,156,574 | A | 10/1992 | Gai | |
| 5,158,568 | A * | 10/1992 | Riddle et al. | 5/618 |
| 5,273,392 | A | 12/1993 | Bernard, II et al. | |
| 5,425,442 | A | 6/1995 | Lichti | |
| 5,490,297 | A * | 2/1996 | Bradcovich et al. | 5/611 |
| 5,802,639 | A * | 9/1998 | Raasch et al. | 5/611 |
| 5,896,702 | A | 4/1999 | Waehrens et al. | |

(Continued)

FOREIGN PATENT DOCUMENTS

EP 0982018 B1 6/2006

(Continued)

OTHER PUBLICATIONS http://www.motioncontrol.com/products/index.cfm/Serapid-Lift-Chain-Catalog New Lift Chain Catalog Available from Serapid Jul. 1, 2008 Serapid 5400 18 Mile Road Sterling Heights, MI 48314 US Phone: 586-274-0774 Website: www.serapid.com.

(Continued)

*Primary Examiner* — Robert G Santos
*Assistant Examiner* — Brittany Wilson
(74) *Attorney, Agent, or Firm* — Kenneth C. Baran

(57) ABSTRACT

A bed includes a base frame 14 having a head end and a foot end, an elevatable frame 16 also having a head end and a foot end, a lift assembly 76 or 78 comprising an actuation system connected to one of the frames, a push chain 106 having an actuator end 124 driven by a lead screw 86 and a distal end 126 connected to the other of the frames. Rotary motion of the lead screw changes elevation of the elevating frame relative to the base frame.

8 Claims, 10 Drawing Sheets

U.S. PATENT DOCUMENTS

| | | | | |
|---|---|---|---|---|
| 5,940,911 | A * | 8/1999 | Wang | 5/611 |
| 6,109,424 | A * | 8/2000 | Doan | 198/468.8 |
| 6,224,037 | B1 | 5/2001 | Novick | |
| 6,505,365 | B1 * | 1/2003 | Hanson et al. | 5/611 |
| 6,601,677 | B1 * | 8/2003 | Storm | 187/200 |
| 6,684,419 | B1 * | 2/2004 | Perla | 5/81.1 R |
| 7,428,760 | B2 * | 9/2008 | McCrimmon | 5/611 |
| 7,874,031 | B2 * | 1/2011 | Groβhauser et al. | 5/601 |
| 2002/0111236 | A1 | 8/2002 | Prince | |
| 2004/0177934 | A1 | 9/2004 | Olmsted | |
| 2006/0219144 | A1 | 10/2006 | Phelan et al. | |
| 2007/0107125 | A1 | 5/2007 | Koch et al. | |
| 2008/0251325 | A1 * | 10/2008 | Bukowski et al. | 187/211 |
| 2009/0293196 | A1 * | 12/2009 | Boomgaarden | 5/608 |
| 2010/0107340 | A1 * | 5/2010 | Koch et al. | 5/607 |
| 2010/0223728 | A1 * | 9/2010 | Hutchison et al. | 5/610 |
| 2011/0099716 | A1 * | 5/2011 | Jackson | 5/617 |

FOREIGN PATENT DOCUMENTS

| | | | |
|---|---|---|---|
| JP | 2004129932 | A * | 4/2004 |
| WO | WO 9623433 | A1 * | 8/1996 |

OTHER PUBLICATIONS http://www.concisemotion.com/chain.htm Innovative Compact Motion Solutions PushPull Chain/LinearChain Date; No later than Dec. 4, 2008 Concise Motion Systems 9440—L San Mateo NE Albuquerque, NM 87113 USA.

http://motionsystemdesign.com/mag/choosing_rigid_chain/ Motion System Design Choosing rigid chain for power By Greg Dettloff Serapid USA Inc. Sterling Heights, MI Oct. 1, 2008.

http://motionsystemdesign.com/mag/PTRAN-PIC2b-serapid_full.jpg Date; No later than Jan. 8, 2009.

http://www.serapid.com/gb/new_products/chainlift.html Chain Lift Date; No later than Jan. 8, 2009.

http://www.serapid.com/gb/new_products/hdlift.html Heavy Duty Lift Systems Date; No later than Jan. 8, 2009.

http://www.serapid.com/gb/new_products/housing_chains.html Serapid Mechanical Actuators: Housing and Chains Date; No later than Jan. 8, 2009.

http://www.serapid.com/gb/theatre/th_app_av_gb.html Serapid Lift Products Applications and Advantages Date; No later than Jan. 8, 2009.

Linear Chain D5-239e2/09.05 Drive housing 25, 40, 60 Frame Morat GmbH & Co. KG Hochst 7 D-79871 Eisenbach Telephone: +49 (0) 7657 / 88-0.

Linear Chain D5-247e2/09.05 Magazine Covers Frame Morat GmbH & Co. KG Hochst 7 D-79871 Eisenbach Telephone: +49 (0) 7657 / 88-0.

http://www.framo-morat.com/e/LinearChain/LinearChain.html Framo Morat—LinearChain Jan. 25, 2008.

U.S. Appl. No. 12/397,511, filed Mar. 4, 2009. Titled "Height Adjustable Bed with Lift Chain Assembly and Components Thereof", Applicant(s) Stephen Hutchinson, Assignee Name and Address: Hill-Rom Services, Inc. 300 Delaware Avenue, Suite 530 Wilmington, DE 19801.

* cited by examiner

HEIGHT ADJUSTABLE BED WITH A PUSH CHAIN ASSEMBLY

TECHNICAL FIELD

The subject matter described herein relates to height adjustable beds and particularly to a bed whose height adjustment system employs a push chain assembly.

BACKGROUND

Beds used in health care facilities and home care settings include a base frame, an elevatable frame and a lift system allowing a patient or caregiver to adjust the height of the elevatable frame. The lift system components reside beneath the elevatable frame and therefore should be compact so that the frame can be positioned at very low elevations. Compactness also makes space available for other under-bed components. However the lift system must also have enough vertical reach to allow the user to raise the frame high enough for a caregiver to attend to the bed occupant. Lift systems that employ telescoping components can satisfy the vertical positioning requirements. However the telescoping components can be susceptible to binding. Therefore, despite the merits of telescoping systems, it is desirable to enlarge the universe of design choices by developing non-telescoping alternatives.

SUMMARY

The subject matter disclosed herein is a bed comprising a base frame having a head end and a foot end, an elevatable frame also having a head end and a foot end, a lift assembly comprising an actuation system connected to one of the frames, a push chain having an actuator end driven by a lead screw and a distal end connected to the other of the frames. Rotary motion of the lead screw changes elevation of the elevating frame relative to the base frame.

BRIEF DESCRIPTION OF THE DRAWINGS

The foregoing and other features of the various embodiments of the bed and lift system described herein will become more apparent from the following detailed description and the accompanying drawings in which.

DETAILED DESCRIPTION

Figure 1:
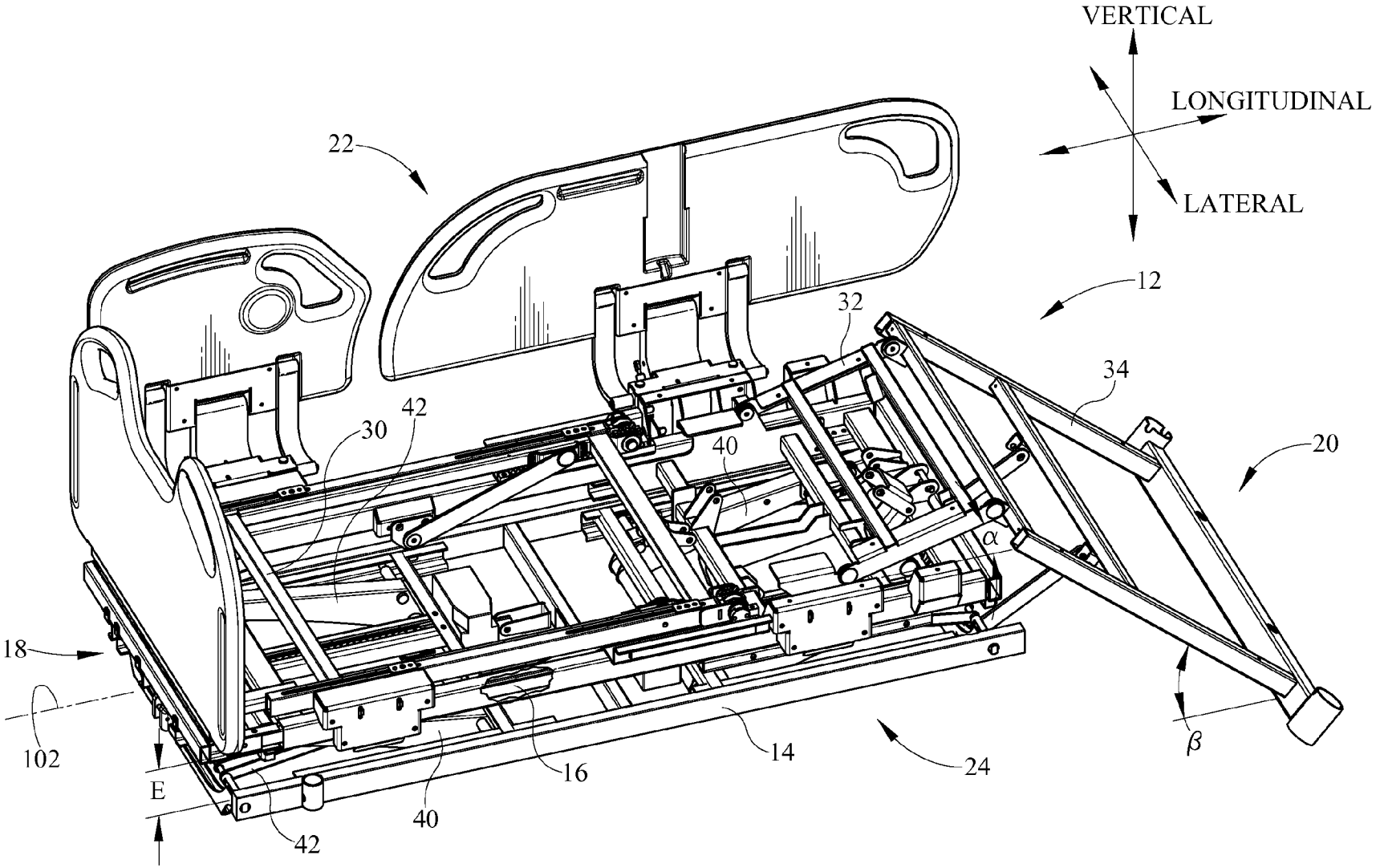
FIG. 1 is a perspective view of a framework for a hospital bed showing a base frame, an elevatable frame and a set of orientation adjustable deck frames as seen by an observer looking from above and positioned to the right of the framework.
Figure 2:
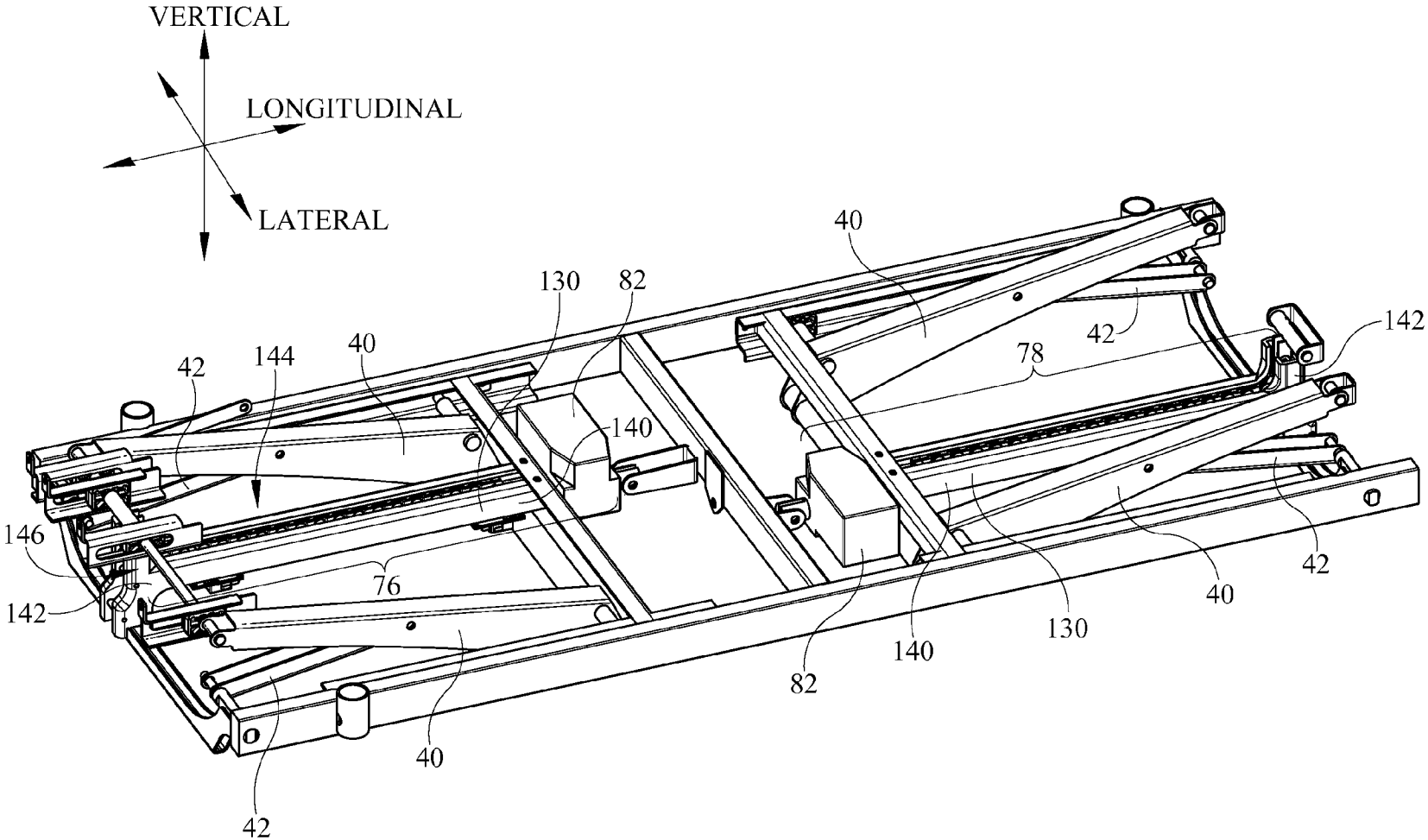
FIG. 2 is a view of the base frame of FIG. 1 showing head and foot end lift assemblies for changing the elevation and/or orientation of the elevating frame relative to the base frame and also showing a set of load bearing links in a folded state consistent with the elevatable frame being at a low elevation.
Figure 3:
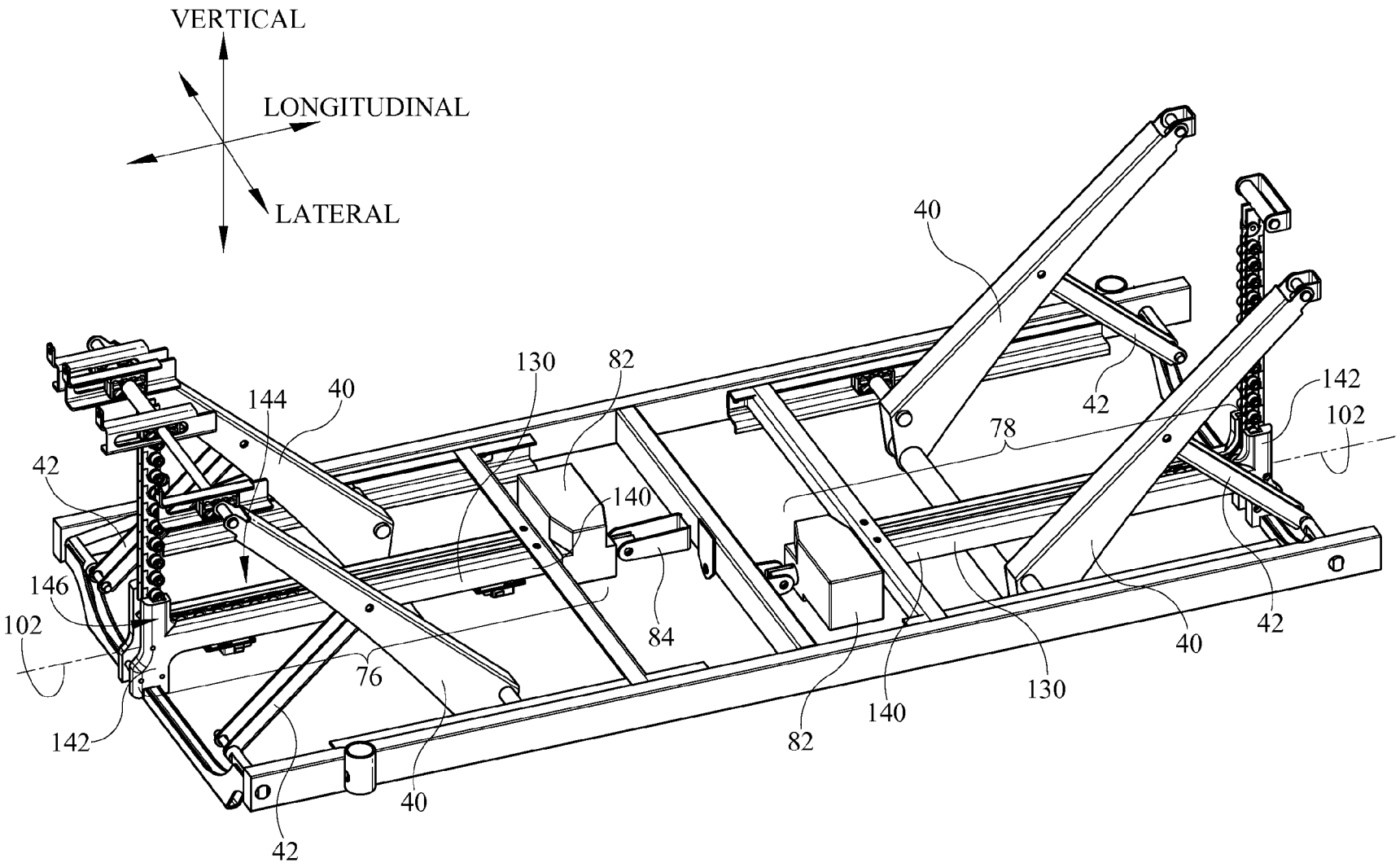
FIG. 3 is a view similar to FIG. 2 showing the links in an unfolded state consistent with the elevatable frame being at a higher elevation.

Referring to FIGS. 1-3, a framework 12 for a hospital bed has a base frame 14 and an elevatable frame 16 whose elevation E relative to the base frame is adjustable. The framework extends longitudinally from a head end 18 to a foot end 20 and laterally from a left side 22 to a right side 24. The elevatable frame supports upper body, thigh, and calf deck section frames 30, 32, 34. The angular orientation of the deck section frames is adjustable. Deck frame 30 is shown at a horizontal orientation, deck frame 32 is shown at an orientation $\alpha$ and frame 34 is shown at an orientation $\beta$. Deck sections, not shown, are affixed to each deck frame. A mattress, also not shown, rests atop the deck sections. Major and minor load bearing links 40, 42 at each of the four corners of the bed bear part of the weight of the elevatable frame and any other loads applied thereto. The links also stabilize the elevatable frame. The illustrations also include longitudinal, lateral and vertical reference axes.

Figure 4:
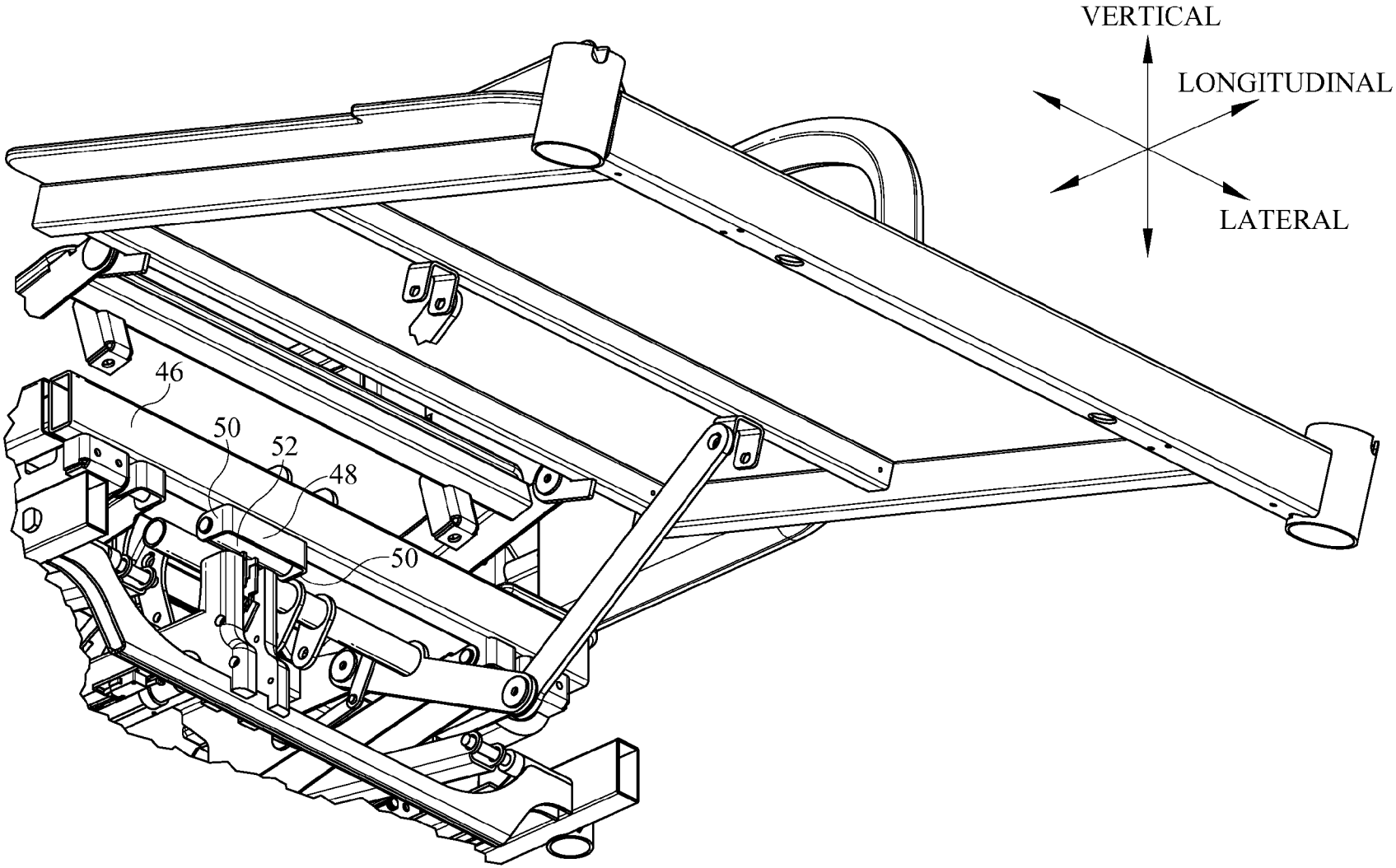
FIG. 4 is a perspective view of the foot end of the framework as seen by an observer looking from underneath and positioned to the right of the framework.

Referring to FIG. 4, the foot end of the elevating frame includes a cross member 46 and a bracket 48 with ears 50. The bracket is attached to the cross member, e.g. by welding. A rod 52 extends between the ears.

Figure 5:
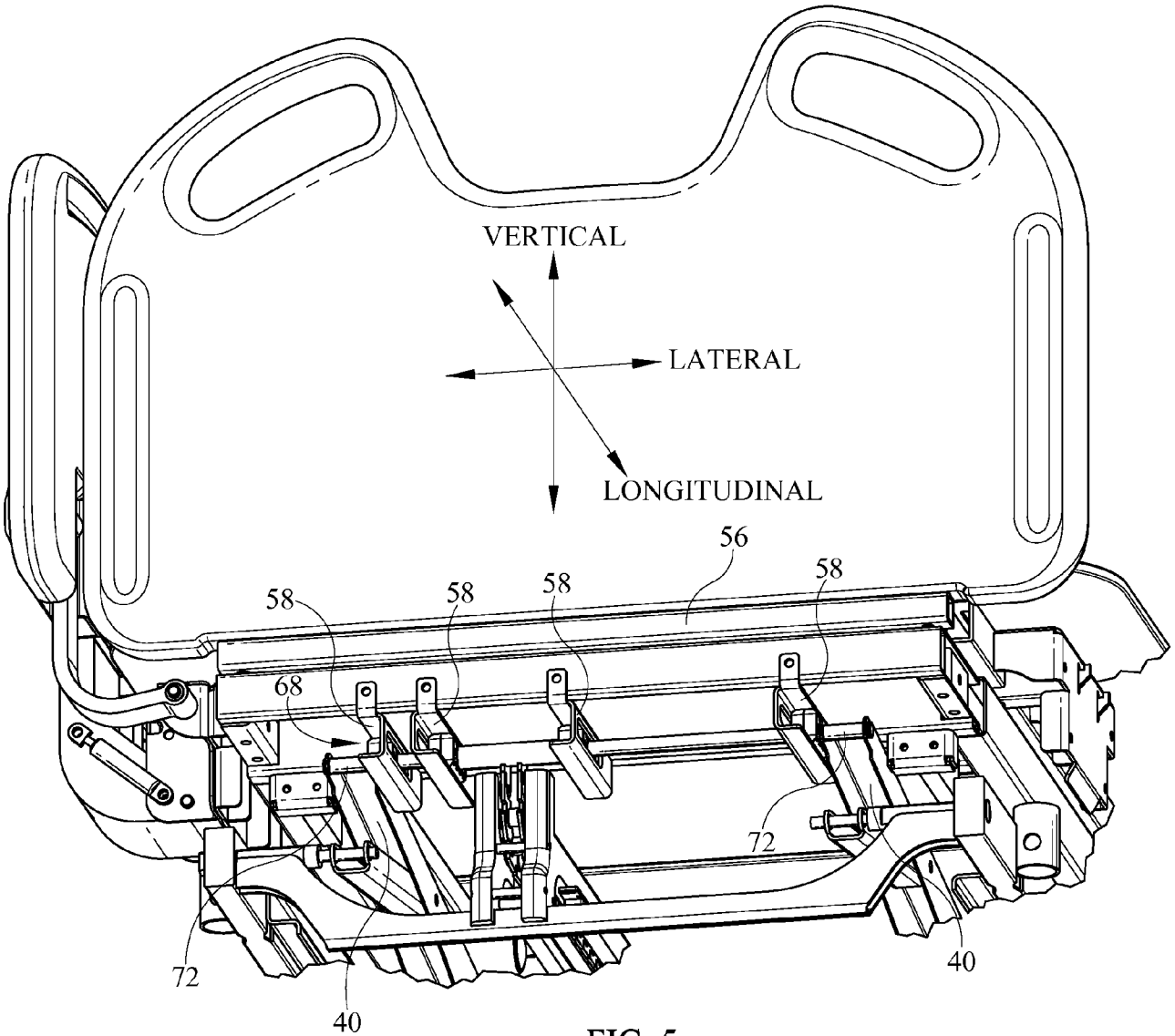
FIG. 5 is a perspective view of the head end of the framework as seen by an observer looking from underneath and positioned slightly to the right of the longitudinal center.
Figure 6:
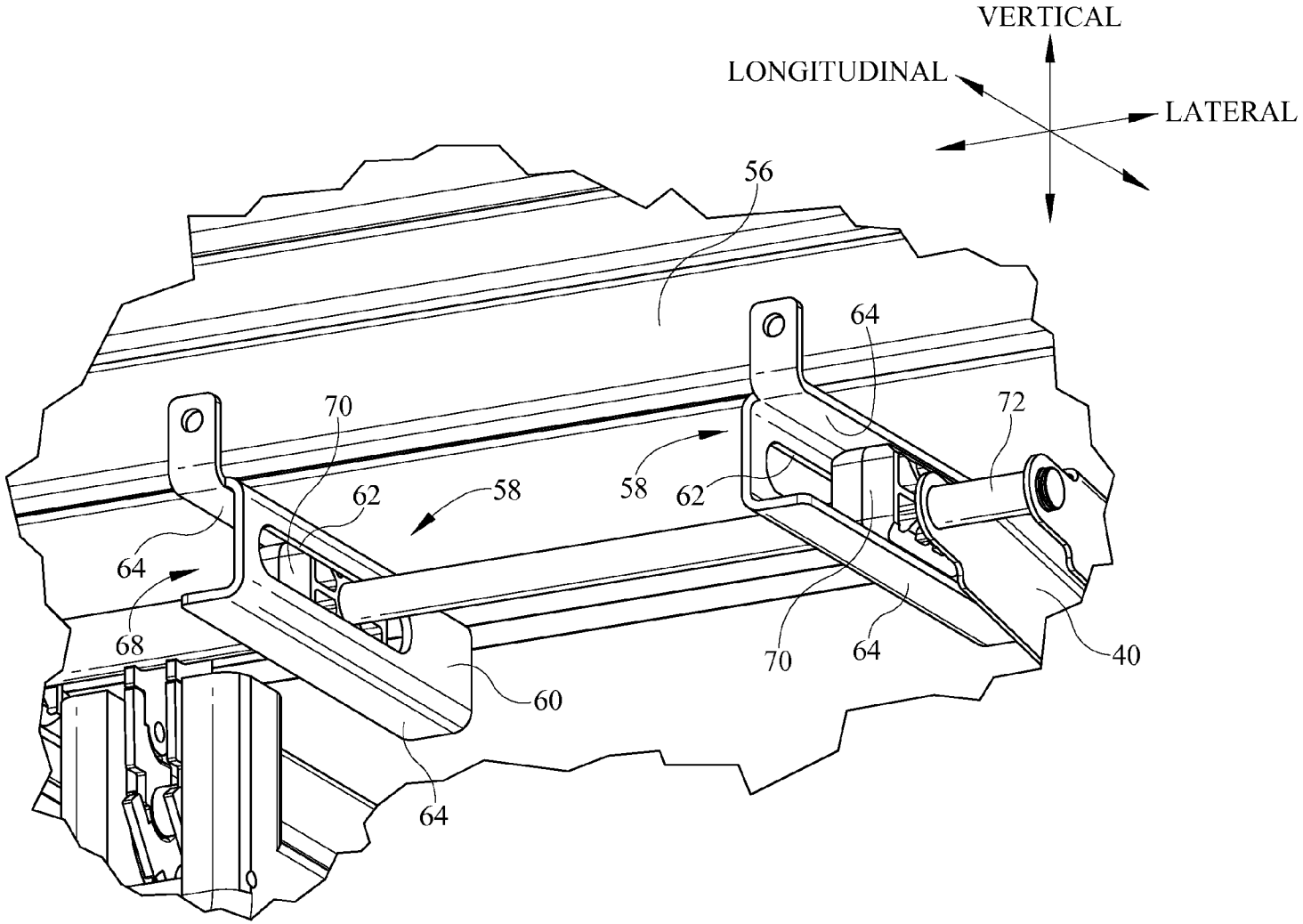
FIG. 6 is an enlarged view of a portion of FIG. 5 viewed from a slightly different perspective.
Figure 7:
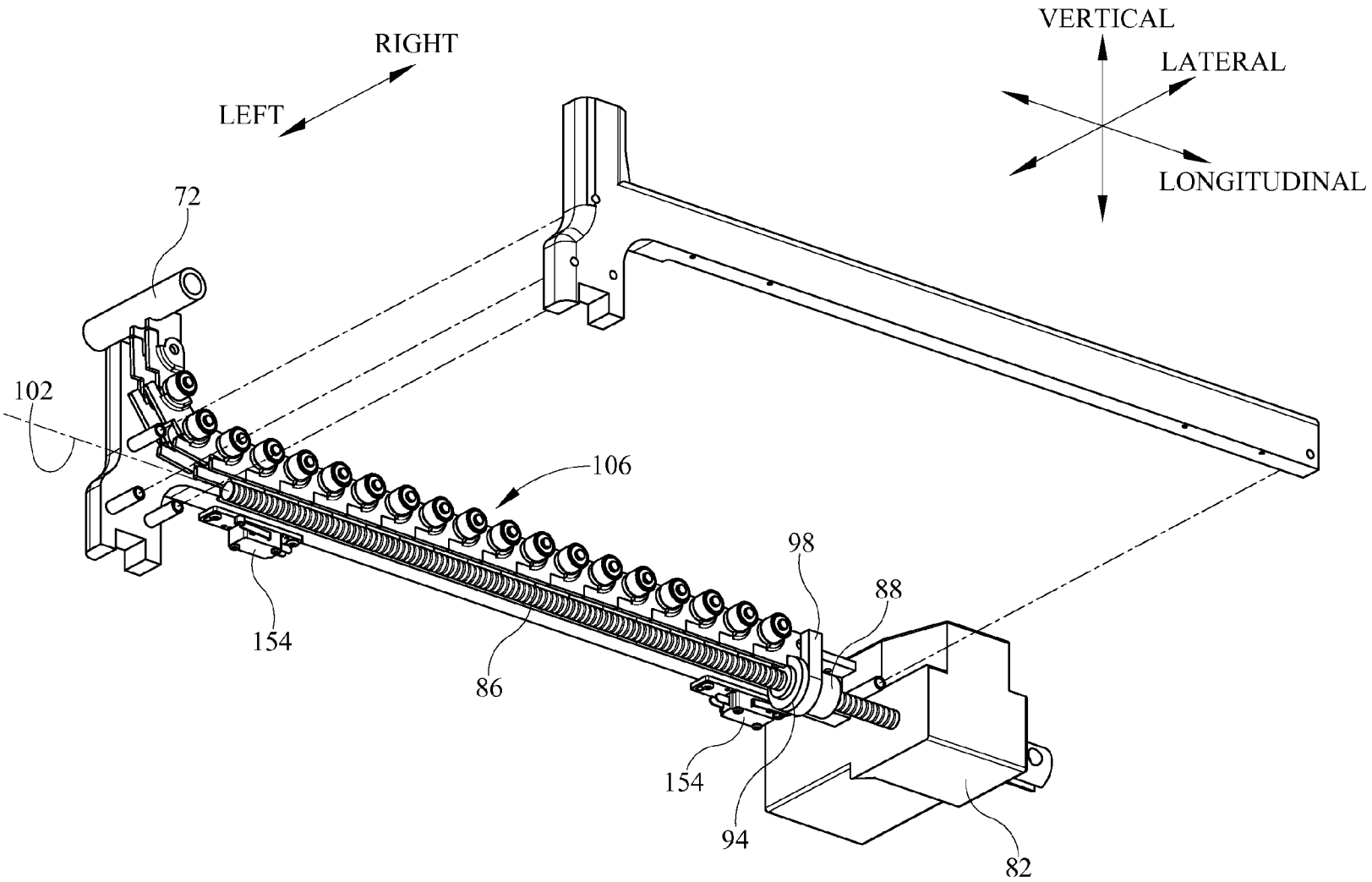
FIG. 7 is a partially exploded perspective view of the head end lift assembly as seen by an observer looking from underneath and positioned to the right of the framework.

Referring to FIGS. 5-6, the head end of the elevating frame includes a cross member 56 and a set of brackets 58 attached to the cross member. Each bracket has a web 60 with an elongated slot 62 therein and a pair of flanges 64. The web and flanges define a channel 68. As seen best in FIG. 6 a slider block 70 resides between the flanges of each bracket and is translatable along the channel. A rod 72 extends laterally through the slider blocks. The lateral extremities of the rod are pivotably connected to the left and right major links 40 at the head end.

The bed includes a head end lift assembly 76 and a foot end lift assembly 78 most easily visible in FIGS. 2, 3 (both assemblies) and 7 (head assembly only). The assemblies are substantially similar to each other and it will suffice to describe only the head end lift assembly. The head end assembly includes an actuation system comprising an actuator 82 connected to the base frame by a bracket 84, and a lead screw 86 projecting from the actuator and rotationally driven thereby. The actuation system also includes a translatable nut 88 having a head end 90 and a shank 92. The nut is mounted on the threads of the lead screw. The actuation system also includes an internally threaded sleeve 94 installed on the shank end of the nut, and a nut adaptor 98 sandwiched between the sleeve and the head of the nut. The nut adaptor circumscribes the lead screw and includes a triplet of vertically extending projections 100 defining a pair of slots 104. The lead screw has a rotational axis 102 substantially nonparallel to the direction of elevation E. In the illustrated embodiment the lead screw axis is substantially horizontal.

The lift assembly also includes a push chain 106. A typical push chain comprises a series of links. Each link is flexibly connected to its neighboring link at their cross axes. However the ends of the links are designed to interlock with the ends of the neighboring links such that when a thrust or compressive force is applied to the chain in the linkwise direction, the links lock together so that the chain resists bending in one direction but is able to bend or coil in the other direction. Under tension, the chain acts as ordinary chain. The illustrated push chain includes a left link plates 108, a right link plates 110, interlink rollers 112, left outboard rollers 114, right outboard rollers 116 and various spacers 118. Connector pins 120 connect the link plates, rollers and spacers together. One end of each link plate includes a shoulder 122 (FIG. 9) that effects the aforementioned interlocking. The chain extends in a linkwise direction from an actuator end 124 (i.e. the end closest to the actuator) to a distal end 126. The terminal link plates at the distal end of the foot end chain are connected to rod 52, for example by welding. The terminal link at the distal end of the head end chain is connected to rod 72, for example by welding. The terminal link at the actuator ends of both chains rest in slots 104 in the respective nut adaptor and are welded to the nut adaptor. The distal ends of the lift chains are laterally offset from each other as seen in FIGS. 1-3.

Figure 8:
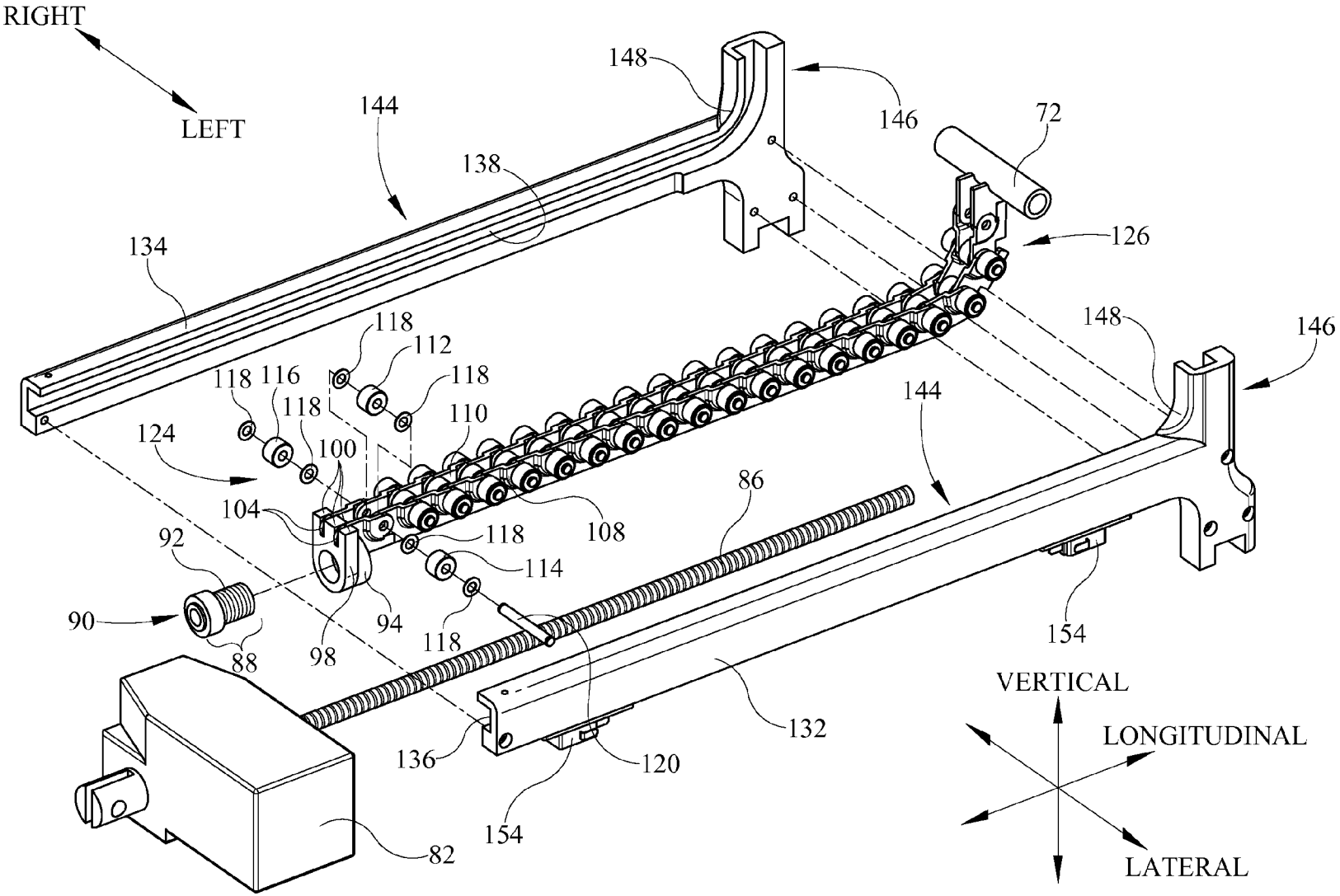
FIG. 8 is a more completely exploded, perspective view of the head end lift assembly as seen by an observer looking from above and positioned to the left of the framework.

A chain guide 130 is connected to the base frame. The chain guide includes left and right rails 132, 134 each of which includes a laterally inwardly facing groove 136, 138. As seen best in FIGS. 2-3 the guide has an actuator end 140 near actuator 82 and a remote end 142 near the longitudinal extremity of the frame. The illustrated chain guide has a horizontal portion 144 and a short vertical portion 146. A corner portion 148 (seen best in FIGS. 8 and 9) joins the longitudinal and vertical portions of the guide to each other. The grooves in the corner portion of the guide rails are curved to connect the grooves of the horizontal portions of each rail with those of the vertical portions of each rail. The outboard rollers 114, 116 of the lift chain project laterally into the rail grooves 136, 138 so that the rails flank at least a portion of the chain. Limit switches 154 are secured to the chain guide, one near its actuator end and one near its remote end.

When the chain is installed in the chain guide as described above, the linkwise direction of the chain is partly substantially parallel to the lead screw rotational axis 102 and partly substantially nonparallel to the lead screw rotational axis. In the illustrated embodiment the nonparallel part is substantially perpendicular to the lead screw axis 102. The chain guide flanks at least the portion of the chain (e.g. corner 148) that joins the substantially parallel part thereof to the substantially nonparallel part thereof.

To raise the elevatable frame 16 without changing its orientation the head and foot end actuators are operated in unison. Each actuator output shaft rotates its lead screw in a "forward" rotational sense so that the nuts 88 advance along the screws thereby translating the nut adaptors 98 toward the ends of the bed. Translation of the nut adaptors pushes the chains along the chain guides. The corner portions of the chain guides turn the chain links from an orientation parallel to the rotational axis to an orientation perpendicular to the axis. As the chains advance, their distal ends push vertically on rods 52, 72 to increase the elevation of the elevating frame. Each actuator stops when its associated nut adaptor 98 contacts the limit switch near the remote end 142 of the chain guide. Alternatively the travel limits could be integrated into the actuator by way of an electrical feedback.

To lower the elevatable frame without changing its orientation the head and foot end actuators are again operated in unison so that each actuator output shaft rotates its lead screw in a "reverse" rotational sense. The nuts 88 retreat along the lead screws thereby translating the nut adaptors 98 away from the ends of the bed. Translation of the nut adaptors pulls the chain through the chain guide. The corner portion of the chain guide turns the chain links from an orientation perpendicular to the rotational axis to an orientation parallel to the axis. Retraction of the chain allows the elevatable frame to move to a lower elevation while still being vertically supported by the chain. Each actuator stops when its associated nut adaptor 98 contacts the limit switch 154 near the actuator end 140 of the chain guide. Alternatively the travel limits could be integrated into the actuator by way of an electrical feedback.

The actuators can be rotated differentially (i.e. in opposite directions, in the same direction at different speeds, or with one actuator operating and one not operating) to differentially adjust the elevation of the head and foot ends of frame 16. During such operation the slider blocks 70 at the head end of the bed slide along the channel 68. Differential operation of the actuators changes the orientation of the elevatable frame.

Figure 9:
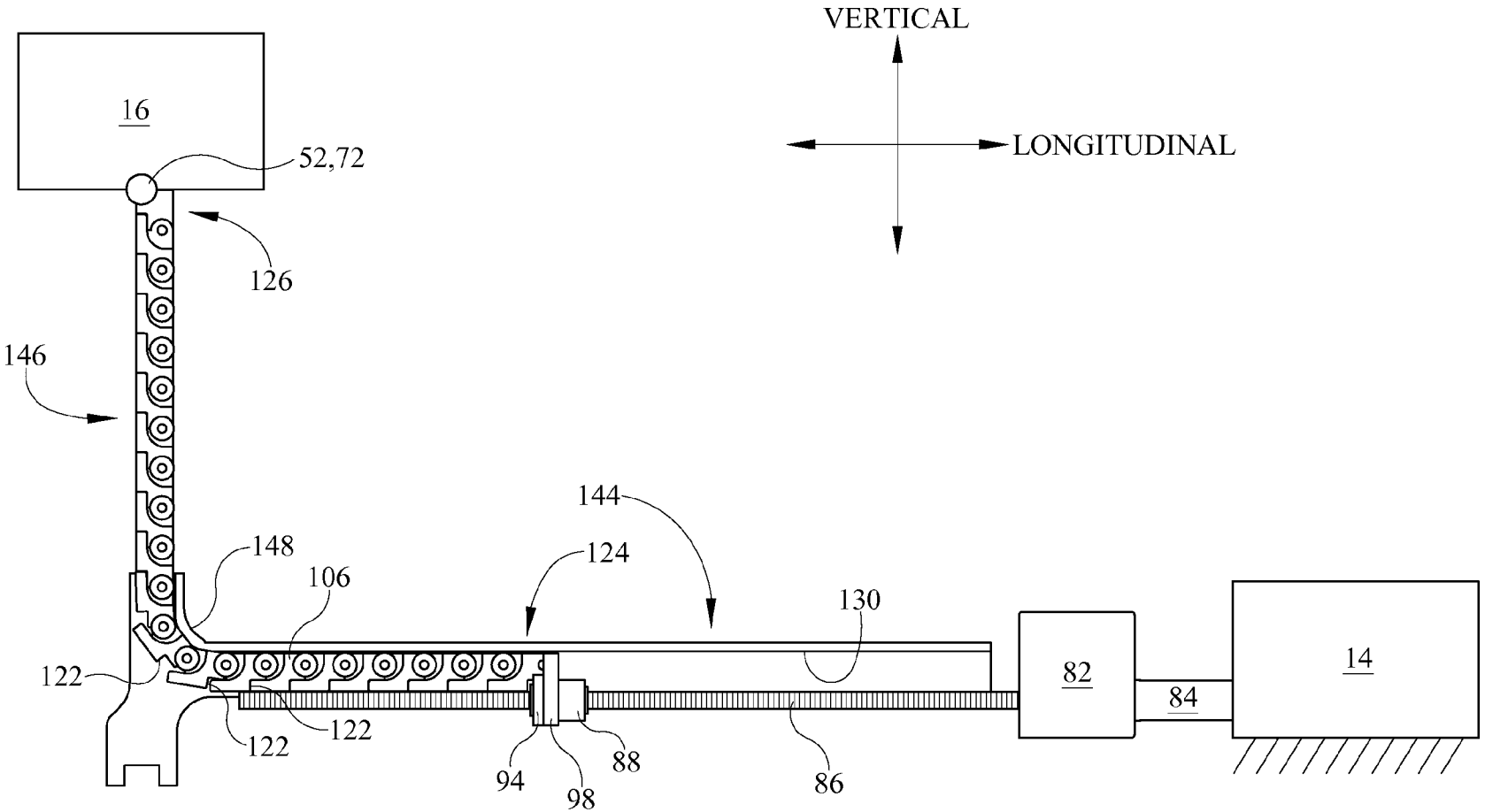
FIG. 9 is a schematic, side elevation view showing the arrangement of the lift assembly components of FIGS. 1-8.

FIG. 9 is a schematic representation of the above described embodiment. Rotation of the lead screw 86 causes the nut 88 to advance or retract, thereby pushing or pulling the chain. The chain moves through the chain guide, which changes the linkwise direction from vertical to horizontal or vice versa, thereby raising or lowering the elevatable frame.

Figure 10:
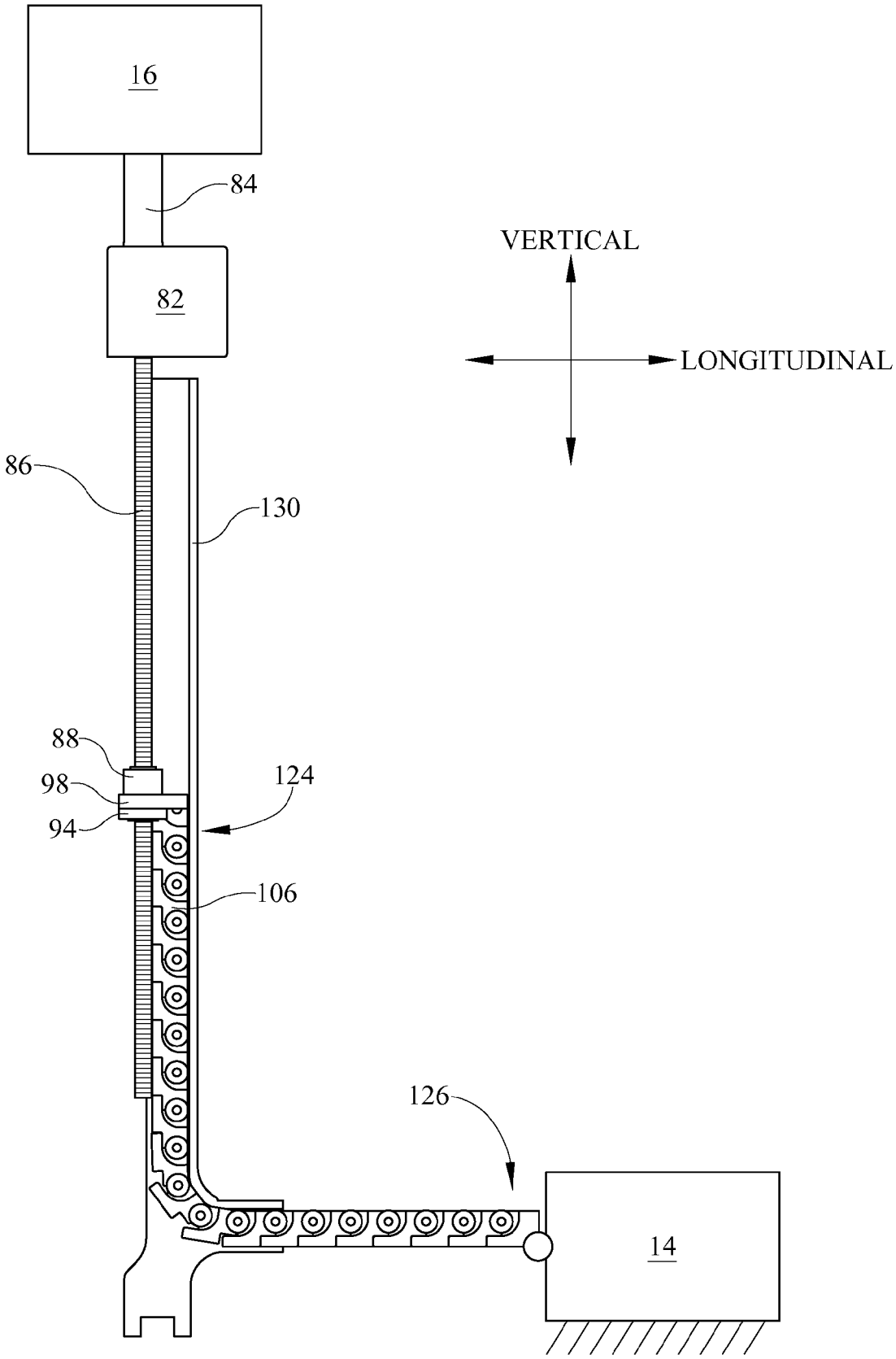
FIG. 10 is a schematic, side elevation view showing an alternate arrangement of the lift assembly components.

FIG. 10 is a schematic representation of a second embodiment in which the actuators are connected to the elevatable frame 16 rather than to the base frame 14. Operation of the actuator 82 advances the leadscrew vertically upwardly or downwardly through the nut to raise or lower the elevatable frame. The chain 106 remains stationary but continues to bear part of the weight of the elevatable frame.

Although this disclosure refers to specific embodiments, it will be understood by those skilled in the art that various changes in form and detail may be made without departing from the subject matter set forth in the accompanying claims.

We claim:

1. A bed comprising:

a base frame having a head end and a foot end;

an elevatable frame having a head end and a foot end;

a lift assembly comprising an actuation system connected to the base frame or the elevatable frame, the actuation system including a lead screw; and a push chain having an actuator end driven by the lead screw and a distal end connected to whichever of the base frame and elevatable frame the actuation system is not connected to;

wherein rotary motion of the lead screw changes elevation of the elevatable frame relative to the base frame.

2. The bed of claim 1 wherein the lead screw has a rotational axis substantially nonparallel to the direction of elevation.

3. The bed of claim 2 including a chain guide flanking at least a portion of the chain.

4. The bed of claim 3 wherein the chain has a linkwise direction, the linkwise direction being partly substantially parallel to the lead screw rotational axis and partly substantially nonparallel to the lead screw rotational axis, and wherein the chain guide flanks a portion of the chain that joins the substantially parallel part thereof to the substantially nonparallel part thereof.

5. The bed of claim 1 comprising:

a first lift assembly including a first actuation system connected to the base frame or the elevatable frame;

a second lift assembly including a second actuation system connected to the base frame or the elevatable frame;

each lift assembly including a lead screw;

a first push chain having an actuator end driven by the first actuation system and a distal end connected to whichever of the base frame and elevatable frame the first actuation system is not connected to;

a second push chain having an actuator end connected to the second actuation system and a distal end connected to whichever of the base frame and elevatable frame the second actuation system is not connected to.

6. The bed of claim 5 wherein the first lift assembly is a head end lift assembly, the second lift assembly is a foot end lift assembly, the first push chain is a head end push chain and the second push chain is a foot end push chain.

7. The bed of claim 6 wherein the distal ends of the push chains are laterally offset from each other.

8. The bed of claim 1 including head end and foot end load bearing links extending from the base frame to the elevatable frame.

* * * * *